US005516238A

United States Patent [19]

Beury

[11] Patent Number: 5,516,238

[45] Date of Patent: May 14, 1996

[54] SYSTEM OF REINFORCEMENT PANELS AND BRACES

[76] Inventor: Fred E. Beury, R.D. 1, Box 422 A-1, Lock Haven, Pa. 17745

[21] Appl. No.: 345,853

[22] Filed: Nov. 28, 1994

[51] Int. Cl.[6] ..... E02D 5/03; E02D 29/02

[52] U.S. Cl. ..... 405/282; 405/284

[58] Field of Search ..... 405/258, 262, 405/282, 284, 285, 283

[56] References Cited

U.S. PATENT DOCUMENTS 5,413,435 5/1995 Batle ..... 405/284

FOREIGN PATENT DOCUMENTS 163283 3/1980 Netherlands ..... 405/284

*Primary Examiner*—David J. Bagnell

[57] ABSTRACT

A system of reinforcement panels and braces comprising a plurality of panels. Each panel is formed in a generally rectangular configuration of a rigid plastic material. Each of the panels has a parallel upper and lower edge and parallel vertical side edges. The upper edge is formed with projections in a box-like configuration extending upwardly therefrom. Each of the lower edges is formed with a plurality of box-like recesses positioned in alignment with the projections for the coupling of like panels one to another in a vertical orientation. Each of the panels has one side edge with a projection along the length thereof with the other side edge formed with a recess along he entire side edge thereof. Each of the panels has a front surface and a rear surface with a plurality of reinforcement projections to add rigidity to the panel. Further included are a plurality of clips which include a plurality of rows and a plurality of columns symmetrically spaced in horizontal and vertical alignments on each face of each panel. Each of the clips is in a generally C-shaped configuration with a flat side coupled to each face of the panel. The clips have open ends with overlapping edges for the receipt and release of the ends of the braces.

3 Claims, 4 Drawing Sheets

SYSTEM OF REINFORCEMENT PANELS AND BRACES

BACKGROUND OF THE INVENTION

1. Field of the Invention

The present invention relates to a system of reinforcement panels and braces and more particularly pertains to keeping the walls of construction ditches and holes from collapsing through the use of the system of interlocking panels and braces.

2. Description of the Prior Art

The use of construction aids of a wide variety of designs and configurations is known in the prior art. More specifically, construction aids of a wide variety of designs and configurations heretofore devised and utilized for the purpose of providing mechanical support on construction sites through a wide variety of methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,766,740 a method and means for shorting the side walls of trenches to prevent their caving in.

U.S. Pat. No. 5,080,533 discloses a safety shield for an excavation trench.

U.S. Pat. No. 5,154,541 discloses a modular earth support system.

U.S. Pat. No. 5,190,412 discloses a quick assembly modular frame.

U.S. Pat. No. 5,195,849 discloses a trench shorting apparatus.

U.S. Pat. No. 5,197,829 discloses a support device for lining ditches.

In this respect, the a system of reinforcement panels and braces according to the present invention substantially departs from the conventional concepts and designs of the prior art, and in doing so provides an apparatus primarily developed for the purpose of keeping the walls of construction ditches and holes from collapsing through the use of the system of interlocking panels and braces.

Therefore, it can be appreciated that there exists a continuing need for a new and improved a system of reinforcement panels and braces which can be used for keeping the walls of construction ditches and holes from collapsing through the use of the system of interlocking panels and braces. In this regard, the present invention substantially fulfills this need.

SUMMARY OF THE INVENTION

In view of the foregoing disadvantages inherent in the known types of construction aids of a wide variety of designs and configurations now present in the prior art, the present invention provides an improved a system of reinforcement panels and braces. As such, the general purpose of the present invention, which will be described subsequently in greater detail, is to provide a new and improved a system of reinforcement panels and braces and method which has all the advantages of the prior art and none of the disadvantages.

To attain this, the present invention essentially comprises a new and improved a system of reinforcement panels and braces comprising, in combination, a plurality of panels, each panel being formed in a generally rectangular configuration of a rigid plastic material, each of the panels having a parallel upper and lower edge and parallel vertical side edges, the upper edge being formed with projections in a box-like configuration extending upwardly therefrom, each of the lower edges being formed with a plurality of box-like recesses positioned in alignment with the projections for the coupling of like panels one to another in a vertical orientation, each of the panels having one side edge with a projection along the length thereof with the other side edge being formed with a recess along the entire side edge thereof, the side edges adapted to be coupled to similarly shaped side edges of similar panels in a grid-like pattern; each of the panels having a front surface and a rear surface with a plurality of X-shaped reinforcement projections to add rigidity to the panels; a plurality of clips including three rows and three columns symmetrically spaced in horizontal and vertical alignment on each face of each panel, each of the clips being in a generally C-shaped configuration with a flat side coupled to each face of the panel, the clips having open ends with overlapping edges adapted to be deformed for the receipt and release of the ends of the braces; and a plurality of elongated braces, each of the elongated braces being in a generally rectangular configuration with long side edges and short end edges with each of the end edges being formed with a rectangular aperture for removably coupling to an associate clip thereby forming a three dimensional reinforcement structure for ditches and holes.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved a system of reinforcement panels and braces which has all the advantages of the prior art construction aids of a wide variety of designs and configurations and none of the disadvantages.

It is another object of the present invention to provide a new and improved a system of reinforcement panels and braces which may be easily and efficiently manufactured and marketed.

It is further object of the present invention to provide a new and improved a system of reinforcement panels and braces which is of durable and reliable construction.

An even further object of the present invention is to provide a new and improved a system of reinforcement panels and braces which is susceptible of a low cost of manufacture with regard to both materials and labor, and which accordingly is then susceptible of low prices of sale to the consuming public, thereby making such a system of reinforcement panels and braces economically available to the buying public.

Still yet another object of the present invention is to provide a new and improved a system of reinforcement panels and braces which provides in the apparatuses and methods of the prior art some of the advantages thereof, while simultaneously overcoming some of the disadvantages normally associated therewith.

Still another object of the present invention is to keep the walls of construction ditches and holes from collapsing through the use of the system of interlocking panels and braces.

Lastly, it is an object of the present invention to provide a system of reinforcement panels and braces comprising a plurality of panels, each panel being formed in a generally rectangular configuration of a rigid plastic material, each of the panels having a parallel upper and lower edge and parallel vertical side edges, the upper edge being formed with projections in a box-like configuration extending upwardly therefrom, each of the lower edges being formed with a plurality of box-like recesses positioned in alignment with the projections for the coupling of like panels one to another in a vertical orientation, each of the panels having one side edge with a projection along the length thereof with the other side edge being formed with a recess along the entire side edge thereof; each of the panels having a front surface and a rear surface with a plurality of reinforcement projections to add rigidity to the panel; and a plurality of clips including a plurality of rows and a plurality of columns symmetrically spaced in horizontal and vertical alignments on each face of each panel, each of the clips being in a generally C-shaped configuration with a flat side coupled to each face of the panel, the clips having open ends with overlapping edges for the receipt and release of the ends of the braces.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
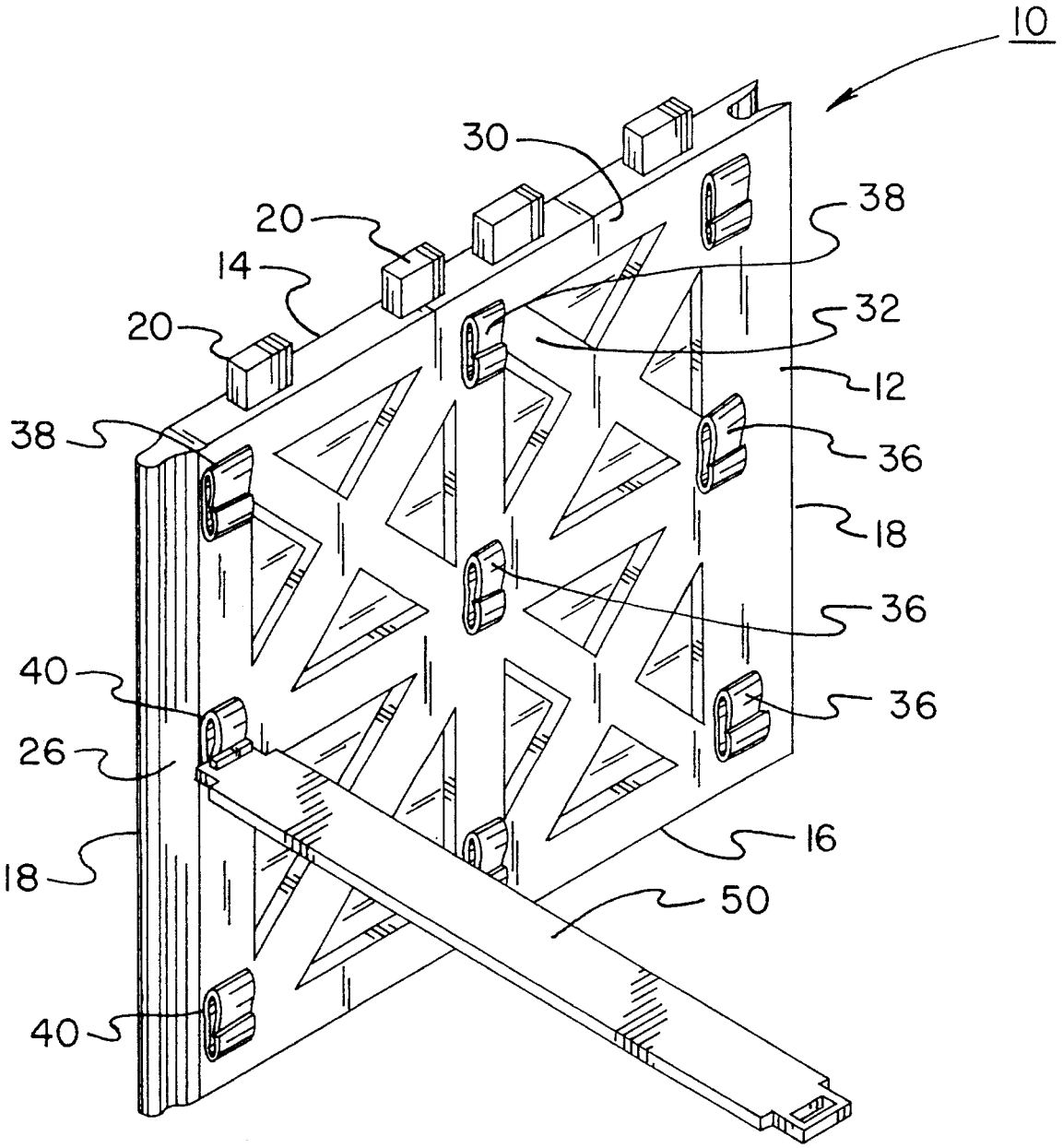
FIG. 1 is a perspective view of the preferred embodiment of the new and improved system of reinforcement panels and braces constructed in accordance with the principles of the present invention.
Figure 2:
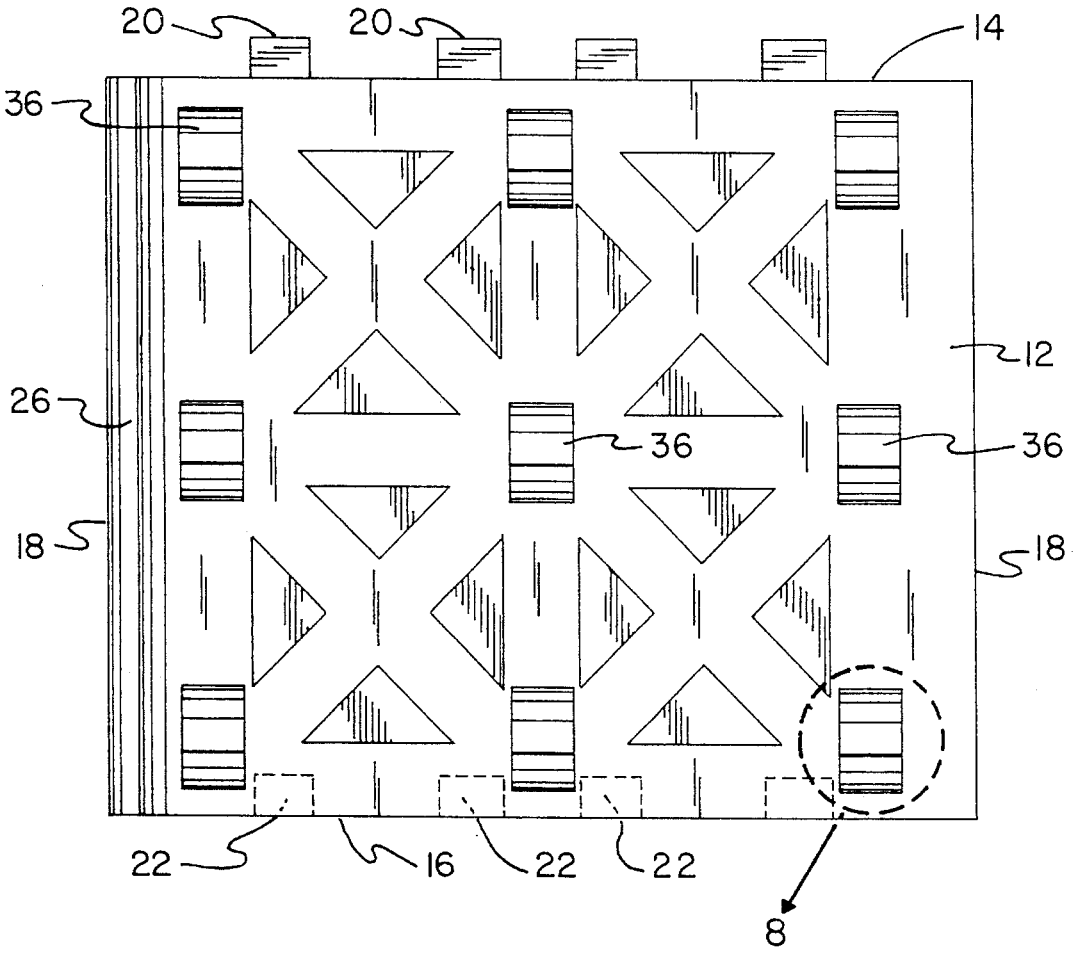
FIG. 2 is a front elevational view of one of the panels shown in FIG. 1.
Figure 3:
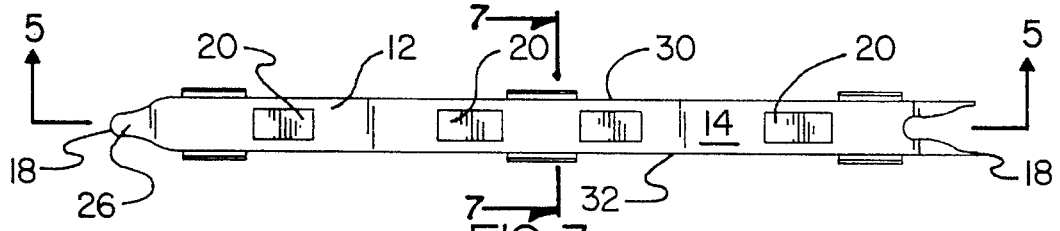
FIG. 3 is a top elevational view of the panel shown in FIG. 2.
Figure 4:
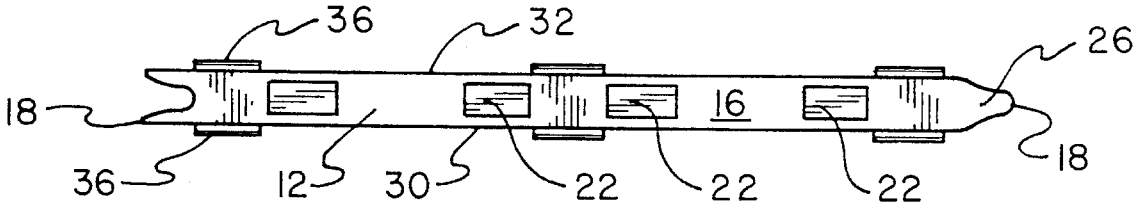
FIG. 4 is a bottom elevational view of the panel shown in FIGS. 2 and 3.
Figure 5:
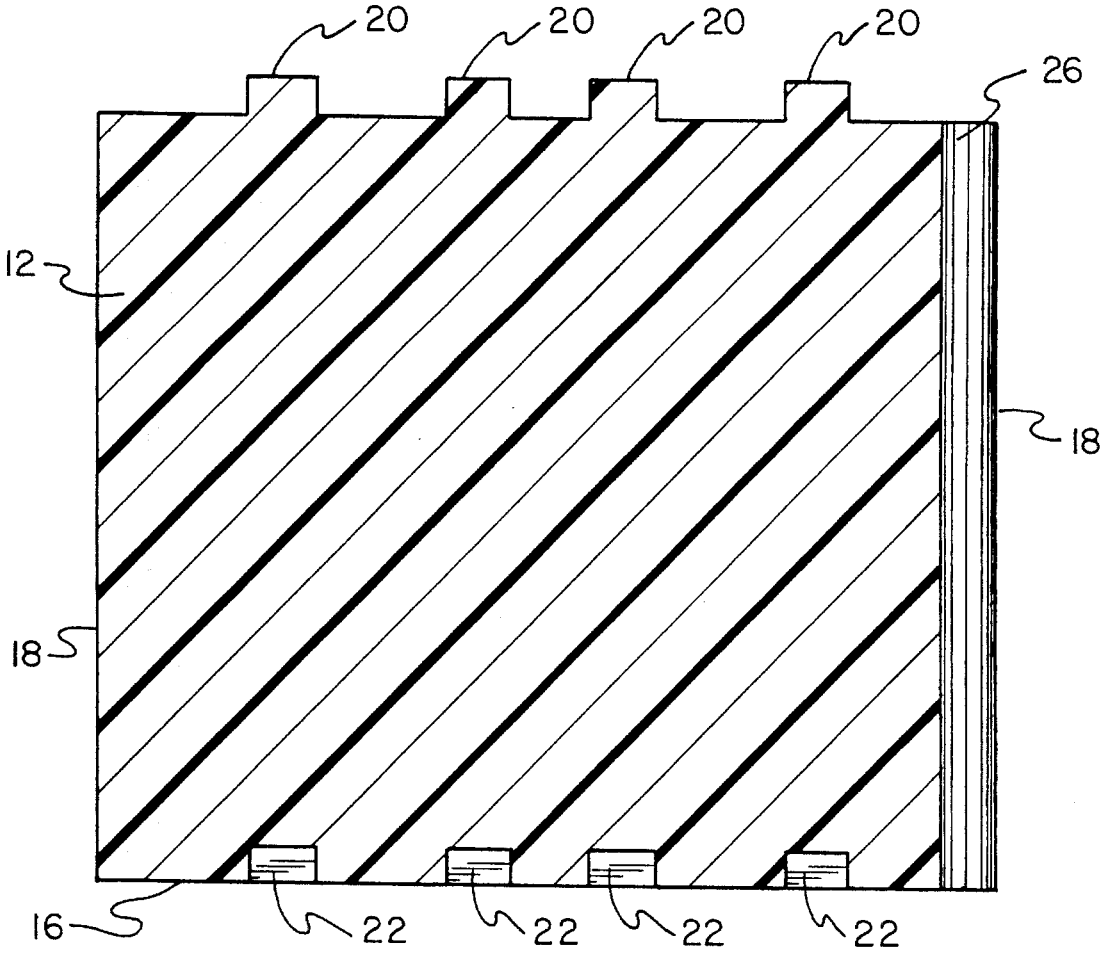
FIG. 5 is a cross-sectional view taken along line 5—5 of FIG. 3.
Figure 6:
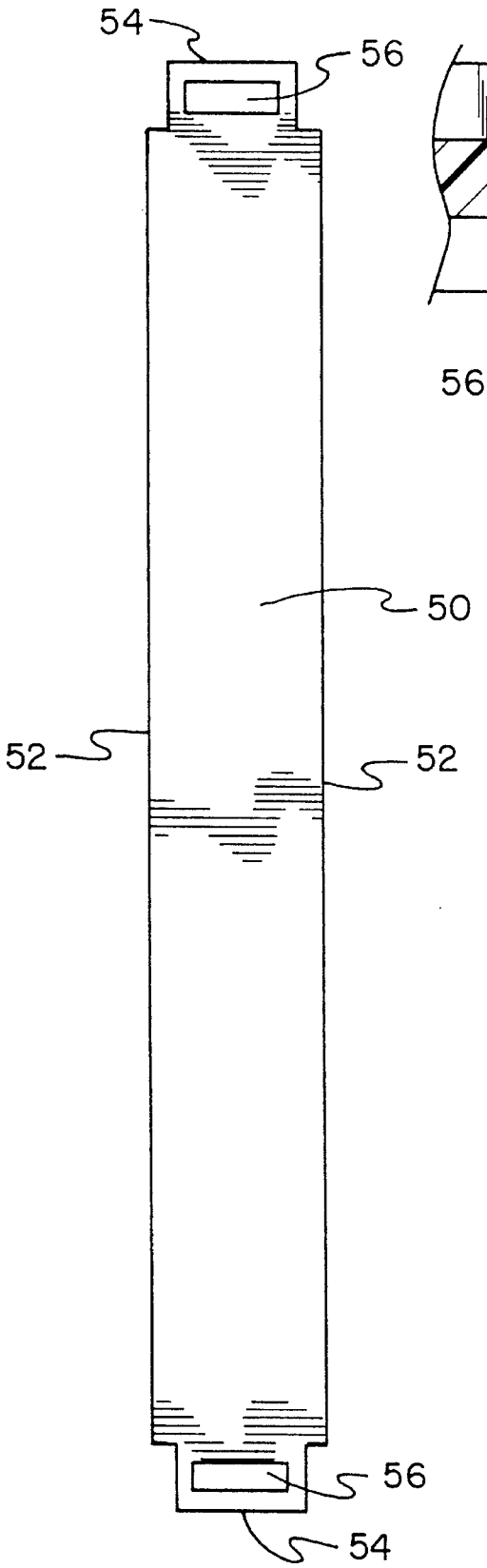
FIG. 6 is a top elevational view of one of the braces shown in FIG. 1.
Figure 7:
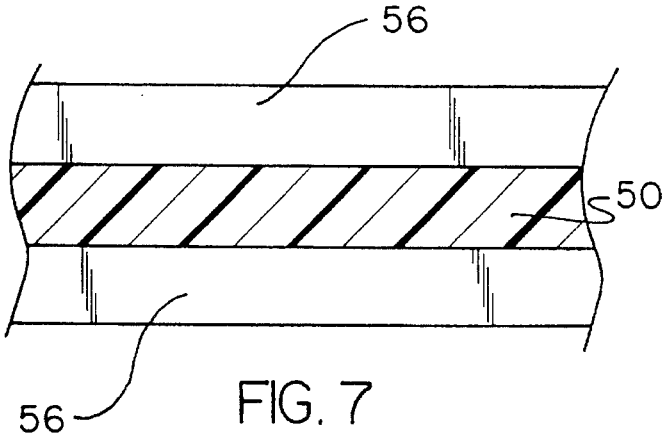
FIG. 7 is a cross-sectional view taken along line 7—7 of FIG. 3.
Figure 8:
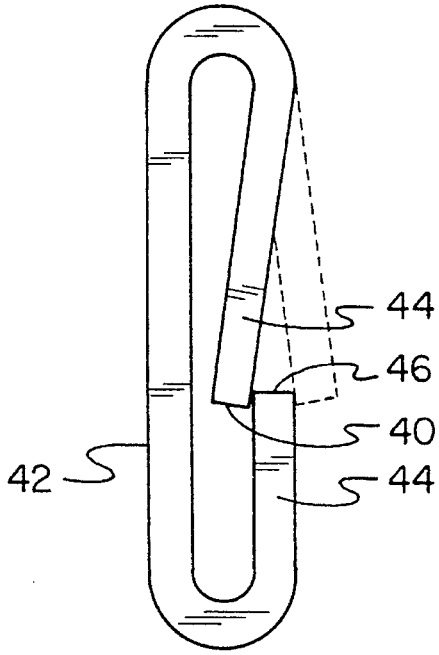
FIG. 8 is an enlarged illustration of one of the coupling components taken about circle 8 of FIG. 2.

With reference now to the drawings, and in particular to FIG. 1 thereof, the preferred embodiment of the new and improved system of reinforcement panels and braces embodying the principles and concepts of the present invention and generally designated by the reference numeral 10 will be described.

The present invention, the new and improved a system of reinforcement panels and braces, is a system 10 comprised of a plurality of components. Such components, in their broadest context, include panels, surfaces on the panels, clips and braces. Such components are individually configured and correlated with respect to each other so as to attain the desired objective.

The central component of the system 10 of the present invention are a plurality of panels 12. Each panel is formed in a generally rectangular configuration of a rigid material, preferably plastic. Each of the panels has a parallel upper and lower edge 14 and 16. Each panel also has parallel vertical sides 18. The upper edge is formed with projections 20 in a box-like configuration. Such projections extend upwardly from the upper surface of the panels. Each of the lower edges is formed with a plurality of box-like recesses 22. Such recesses are positioned in alignment with the projections for the coupling of like panels, one to another, in a vertical orientation during operation and use.

Each of the panels has one side edge with a projection 26 along the length thereof. The other side edge is formed with a recess along the entire side edge thereof. The side edges are thus adapted to be coupled to similarly-shaped side edges of similar panels. In this manner, they may form a grid-like pattern.

Each of the panels has a front surface 30 and a rear surface 32 with a plurality of X-shaped reinforcement projections 32. Such projections add rigidity to the panels.

Coupling between panels is effected through clips 36 on the front and rear surfaces. Such clips include three rows 38 and three columns 40 symmetrically spaced in horizontal and vertical alignment on each face of each panel. Each of the clips is in a generally C-shaped configuration. It includes a flat side 42 coupled to each face of the panel. The clips have opened ends 44 with overlapping edges 46. This arrangement is adapted to be deformed for the receipt and release of the ends of the braces.

Lastly, a plurality of elongated braces 50 are provided. Each of the elongated braces is of a generally rectangular configuration. Each includes long side edges 52 and short end edges 54. Each of the end edges is formed with a rectangular aperture 56. This is for removably coupling to an associated clip. This thereby forms a three-dimensional reinforcement structure for use in ditches and holes and the like.

The present invention is comprised of strong hard molded plastic, and consists of lightweight panels that interlock with cross braces that connect one set of panels to another. The panels can be made in various sizes, depending on how they are employed, but a size for general use if four feet square. Four quarter panels with X's inside them are molded into each panel. Nine interlocking holes for the cross braces are located on each panel. Four short, handle-like projections located on the panel's top edge and four corresponding shallow slots located on its bottom edge are for meshing the panels, one on top of another. One vertical edge has a tapered projection running its length and the other has a matching groove to mesh panels side to side. The braces can be made in various lengths, for example two, four and six feet, and have short, handle-like projections on both ends to interlock perpendicular to the panels. Metal reinforcement members can be implanted into the plastic panels.

Individual panels are connected together in the same plane and cross braces are meshed perpendicular to them to create reinforcement walls to keep the dirt walls in a construction hole from collapsing.

The panels of the present invention are lightweight, easy to assemble and disassemble, and easy to transport. They are designed so they can be easily removed from a hole, even after it has been partially filled.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved a system of reinforcement panels and braces comprising, in combination:

a plurality of panels, each panel being formed in a generally rectangular configuration of a rigid plastic material, each of the panels having a parallel upper and lower edge and parallel vertical side edges, the upper edge being formed with projections in a box-like configuration extending upwardly therefrom, each of the lower edges being formed with a plurality of box-like recesses positioned in alignment with the projections for the coupling of like panels one to another in a vertical orientation, each of the panels having one side edge with a projection along the length thereof with the other side edge being formed with a recess along the entire side edge thereof, the side edges adapted to be coupled to similarly shaped side edges of similar panels in a grid-like pattern;

each of the panels having a front surface and a rear surface with a plurality of X-shaped reinforcement projections to add rigidity to the panels;

a plurality of clips including three rows and three columns symmetrically spaced in horizontal and vertical alignment on each face of each panel, each of the clips being in a generally C-shaped configuration with a flat side coupled to each face of the panel, the clips having open ends with overlapping; and a plurality of elongated braces, each of the elongated braces being in a generally rectangular configuration with long side edges and short end edges with each of the end edges being formed with a rectangular aperture for removably coupling to an associate clip thereby forming a three dimensional reinforcement structure for ditches and holes, the braces adapted to have their end edges received by the clips.

2. A system of reinforcement panels and braces comprising:

a plurality of panels, each panel being formed in a generally rectangular configuration of a rigid plastic material, each of the panels having a parallel upper and lower edge and parallel vertical side edges, the upper edge being formed with projections in a box-like configuration extending upwardly therefrom, each of the lower edges being formed with a plurality of box-like recesses positioned in alignment with the projections for the coupling of like panels one to another in a vertical orientation, each of the panels having one side edge with a projection along the length thereof with the other side edge being formed with a recess along the entire side edge thereof;

each of the panels having a front surface and a rear surface with a plurality of reinforcement projections to add rigidity to the panel; and a plurality of clips including a plurality of rows and a plurality of columns symmetrically spaced in horizontal and vertical alignments on each face of each panel, each of the clips being in a generally C-shaped configuration with a flat side coupled to each face of the panel, the braces adapted to have their end edges received by the clips.

3. The apparatus as set forth in claim 2 and further including:

a plurality of elongated braces, each of the elongated braces being in a generally rectangular configuration with long side edges and short end edges with each of the end edges being formed with a rectangular aperture for removably coupling to an associate clip thereby forming a three dimensional reinforcement structure for ditches and holes.

* * * * *